United States Patent [19]

Login et al.

[11] 4,210,685

[45] Jul. 1, 1980

[54] POLYESTER-STARCH SIZED PAPER, SIZING COMPOSITION, AND PROCESS THEREFOR

[75] Inventors: Robert B. Login; Daniel R. Dutton, both of Woodhaven, Mich.

[73] Assignee: BASF Wyandotte Corporation, Wyandotte, Mich.

[21] Appl. No.: 908,403

[22] Filed: May 22, 1978

[51] Int. Cl.[2] ..... B05D 3/02; B05D 3/12

[52] U.S. Cl. ..... 427/361; 427/364; 427/391; 528/287; 260/29.2 E; 525/437

[58] Field of Search ..... 427/361, 364, 391; 528/287, 273; 260/29.2 E

[56] References Cited

U.S. PATENT DOCUMENTS

| | | | |
|---|---|---|---|
| 3,102,064 | 8/1963 | Wurzburg et al. | 162/158 |
| 3,413,139 | 11/1968 | Rasmussen et al. | 427/348 X |
| 4,098,741 | 7/1978 | Login | 528/287 X |
| 4,111,816 | 9/1978 | Login | 528/287 X |

*Primary Examiner*—Michael R. Lusignan
*Attorney, Agent, or Firm*—Andrew E. Pierce

[57] ABSTRACT

There is disclosed a cellulosic material such as paper or paperboard surface-sized with an aqueous dispersion of a combination of degraded starch or a starch derivative and a branched-chain, water-dispersible polyester condensation product. Said polyester is derived from the reaction of a dicarboxylic reactant, a diol or polyoxyalkylene glycol, and a phosphorus acid reactant wherein said polyester has a carboxylic acid number of about 5 to about 15 and an average molecular weight of about 4,000 to about 11,000. Mixtures of said starch and said polyester when used to surface-size cellulosic materials impart water resistance thereto.

5 Claims, No Drawings

POLYESTER-STARCH SIZED PAPER, SIZING COMPOSITION, AND PROCESS THEREFOR

BACKGROUND OF THE INVENTION

1. Field of the Invention

This invention relates to paper sizing compositions comprising a hydrophilic natural polymer such as a starch in combination with a polyester and improved water resistant papers sized therewith.

2. Description of the Prior Art

Surface sizing of paper using a tub or calendar means generally involves the application of dispersions of film-forming substances such as converted starches, gums, and modified polymers to an already formed paper or paperboard. Generally paper or paperboard is surface sized to control porosity, lay surface fuzz, improve printing ink pick resistance, and increase strength properties. Often paper or paperboard that is to be surface or tub sized contains internal sizing agents which regulate both the depth of penetration and the amount of the surface-sizing dispersion. While internal sizing is advantageous in providing resistance to water penetration throughout the paper or paperboard, surface sizing effects are generally confined to the external surface. The use of starch and glue as well as plant extracts as a surface size for paper apparently predates the discovery that improved water resistance can be imparted to paper with partially saponified rosin and alum as in internal sizing. With the advent of degraded, or modified, starches such as the alkaline-hypochlorite-oxidized starches and starch derivatives such as cationic starches, hydroxyethyl starch ethers and cyanoethyl starch ethers, renewed interest in the use of starch as a surface size occurrred since these modified natural polymers effectively improve the surface properties of paper and paperboard and reduce the water sensitivity thereof. Because increased resistance to water is often necessary even with the use of such modified starches as size for paper and paperboard, particularly where such papers are used for off-set printing, it has been necessary to use mixtures of various polymers in dispersion form in admixture with the modified starches to impart increased water resistance to the surface sized paper and paperboard. One such size composition is disclosed in U.S. Pat. No. 3,931,422 wherein a surface-size composition including starch and a polyester of a polyhydric alcohol and trimellitic acid is utilized to provide improved "hold-out," or water resistance, to paper and paperboard. Because the so called "cationic" starches have a reduced biological oxygen demand, these modified starches have recently come into use as components of paper and paperboard sizing compositions as indicated by U.S. Pat. No. 4,029,885.

SUMMARY OF THE INVENTION

It is a primary object of this invention to provide new sizing compositions for paper and paperboard which are useful in improving the water resistance or holdout of paper and paperboard sized therewith. The size compositions of the invention comprise degraded starch or a starch derivative and a polyester containing branching in the chain which is rendered water-dispersible upon reaction with a base. The combination of the granular starch, water, and polyester is generally heated to "paste" the starch prior to application to the paper or paperboard utilizing a size press. Various starches can be utilized in combination with the branched-chain polyester such as alkaline-hypochlorite-oxidized starch, hydroxyethyl starch ethers, and cyanoethyl starch ethers as well as the cationic starches, disclosed, for instance, in U.S. Pat. No. 4,029,885, hereby incorporated by reference.

Detailed Description of the Invention and of the Preferred Embodiments

It has not been heretofore found that the hold-out or water resistance of cellulosic based paper and paperboard can be improved over the use of starch sizing agents alone by combining together with a degraded starch or starch derivative sizing agent a water-dispersible polyester. Useful polyesters are those having a branched chain and derived from the condensation of a dicarboxylic reactant, a diol or polyoxyalkylene glycol and a phosphorus acid reactant selected from the group consisting of ortho phosphoric acid, polyphosphoric acid and phosphorus pentoxide. Such polyesters are rendered water-dispersible upon the reaction of said polyester with a base. Thus such polyesters are particularly suited for combination with starch in an aqueous medium and can be applied to paper on a conventional size press during the manufacture of paper and paperboard. The applicants believe that the improved water resistance of paper and paperboard sized with the compositions of the invention results not only from the interaction of the polyester phosphate groups with the hydroxyl groups on the starch but also from the admixture therewith of the less water-sensitive polyester. In preparing the aqueous sizing composition, an aqueous dispersion of the polyester is added to a slurry of the starch and water and the composition heated to a temperature of about 190° F. and held for a period of 10 to 60 minutes to swell the starch granules and allow them to burst producing the familiar "pasting" of the starch. The polyester is rendered water-dispersible by reaction in an aqueous medium either with a base which can be a fixed alkali such as sodium bicarbonate or preferably with a volatile alkali such as a volatile amine or ammonium hydroxide. Illustrative amines are isopropylamine, n-propylamine, ethylamine, and triethanolamine. Upon deposition in combination with the starch as a size, the film-forming tendency of the polyester acts to insulate the starch from exposure to moisture thus resulting in improved water resistance of paper sized with the composition.

The fixed alkali base utilized to render the polyester size additive water-dispersible is generally an alkali metal hydroxide and preferably a salt thereof with a weak acid such as carbonic acid as exemplified by sodium carbonate and sodium bicarbonate. Unexpectedly, the alkaline earth metal hydroxides and salts of weak acids do not react with the polyester size to render the polyester water-dispersible. Instead, such materials are useful as an after-treatment wherein the sized paper is exposed to an aqueous solution containing alkaline earth metal ions so as to cause to occur what is believed to be a crosslinking reaction which improves the water-resistance of the sized paper even further. This effect can be obtained simply by passing the polyester and starch sized paper through an aqueous solution of a salt of an alkaline earth metal hydroxide using a size press. Representative alkaline earth metal ions useful in obtaining the insolubilizing effect are calcium, magnesium, and barium.

The polyesters useful in this invention have branched chains and an average molecular weight of about 4,000 to about 11,000 and a carboxylic acid number of about 5 to about 15. Such polyesters are more fully described in co-pending U.S. Patent application Ser. No. 727,991, filed Sept. 30, 1976, now U.S. Pat. No. 4,098,741, incorporated herein by reference. Generally the polyesters are condensation products of a dicarboxylic reactant, at least one diol or polyoxyalkylene glycol and a phosphorus acid reactant. A representative polyester is prepared by reacting isophthalic acid with diethylene glycol and ortho phosphoric acid. The dicarboxylic reactant is used in an amount of about 45 to about 35 mole percent, the diol or polyoxyalkylene glycol is utilized in the proportion of about 50 mole percent and the phosphorus acid reactant is utilized in the proportion of about 5 to about 15 mole percent.

The polyester composition of the invention is prepared from an aromatic, aliphatic or cycloaliphatic dicarboxylic reactant such as dicarboxylic acids and esters, their corresponding acyl halides, or their corresponding anhydrides where they exist or mixtures thereof. Examples of useful acid anhydrides are: phthalic and maleic anhydrides. Examples of useful dicarboxylic acids are phthalic, terephthalic, isophthalic, oxalic, malonic, succinic, glutaric, 2,2-dimethylglutaric, adipic, pimelic, azelaic, sebacic, maleic, itaconic, fumaric, 1,3-cyclopentane dicarboxylic, 1,2-cyclohexane dicarboxylic, 1,3-cyclohexane dicarboxylic, 1,4-cyclohexane dicarboxylic, 2,5-norbornane dicarboxylic, 1,4-naphthalic, diphenic, 4,4-oxydibenzoic, 4,4' sulfonyl dibenzoic, diglycolic, thiodipropionic, and 2,5-naphthalene dicarboxylic acids. Because of their known contribution to film strength in polyesters, the aromatic diacids such as isophthalic acid or terephthalic acid are preferred. Suitable mixtures of these dicarboxylic acids can be utilized to obtain desired modifications of physical properties in the polyester composition as is well known by those skilled in the art. The corresponding esters and acyl halides of the above enumerated dicarboxylic acids can also be used in preparing the polyester compositions. Examples of representative esters include dimethyl 1,4-cyclohexanedicarboxylate, dimethyl 2,6-naphthalenedicarboxylate, dibutyl 4,4'-sulfonyldibenzoate, dimethyl isophthalate, dimethyl terephthalate, and diphenyl terephthalate. Acyl halides are characterized by the general formula RCOX, wherein R is aliphatic, aromatic or cycloaliphatic and X is chlorine, bromine or fluorine. Examples of useful compounds are: terephthaloyl dichloride, isophthaloyl dichloride, malonyl dichloride, itaconyl dichloride. Copolyesters can be prepared from two or more of the above dicarboxylic reactants or derivatives thereof.

The diol or polyoxyalkylene glycol used in preparing the novel polyester size compositions of the invention can be a poly(alkylene glycol) having the generalized formula:

$$H(OCH_2\overset{\overset{R}{|}}{C}H)_nOH$$

and wherein n is an integer of from 1 to about 10, or a poly(methylene glycol) having the generalized formula:

$$HO(\overset{\overset{R}{|}}{C}H)_mOH$$

wherein m is an integer of from 3 to about 10 and R is hydrogen, methyl, ethyl, phenyl or glycidol (—$CH_2$—O—R') in which R' is phenyl, butyl, or mixtures thereof.

Examples of useful polyoxyalkylene glycols are the polyethylene, polypropylene and polyethylene-polypropylene glycols which include diethylene, triethylene, tetraethylene, pentaethylene, hexaethylene, heptaethylene, octaethylene, nonacethylene, decaethylene, dipropylene glycols and mixtures thereof. Preferably the poly(oxyalkylene glycol) is selected from the group consisting of diethylene glycol, triethylene glycol and mixtures thereof.

The diol component of the polyester of the invention can consist of aliphatic, cycloaliphatic and aromatic glycols. Examples of useful diols (glycols) include ethylene glycol; propylene glycol; 1,3-propanediol; neopentyl glycol; 2,4-dimethyl-2-ethylhexane-1,3-propanediol; 2,-ethyl-2-butyl-1,3-propanediol; 2,-ethyl-2-isobutyl-1,3-propanediol; 1,3-butanediol; 1,4-butanediol; 1,5-pentanediol; 1,6-hexanediol; 2,2,4-trimethyl-1,6-hexanediol; 1,2-cyclohexanedimethanol; 1,3-cyclohexanedimethanol; 1,4-cyclohexanedimethanol; 2,2,4,4-tetramethyl-1,3-cyclobutanediol; p-xylylenediol; catechol; resorcinol; and hydroquinone. Preferably, the poly(methylene glycol) is selected from the group consisting of ethylene glycol, propylene glycol and 1,4-butanediol. Copolymers can be prepared from two or more of the above glycols.

The diol or polyoxyalkylene glycol can also include a minor amount of a polyol. Thus up to 20 mole percent of a polyol can be used to replace a portion of the diol component. The term "polyol" as used herein refers to an organic compound having more than two (2) hydroxyl groups per molecule as determined by the average of the hydroxyl groups per molecule. Such polyols are well known in the art. They are often prepared by the catalytic condensation of an alkylene oxide or mixture of alkylene oxides either simultaneously or sequentially with an organic compound having more than two active hydrogen atoms. Representative polyols include the polyhydroxy-containing polyesters, polyalkylene polyether polyols derived from alkylene oxides such as ethylene oxide, propylene oxide and butylene oxide and adducts of polyhydric or polythiol ethers or amine initiators. Where it is desired to include a polyol having a functionality greater than 2 as part of the hydroxy-containing component of the polyester of the invention, it is necessary to add a compensating amount of a monofunctional acid such as stearic acid or benzoic acid in order to avoid gelation early in the polymerization as predicted by the Carothers equation.

The dicarboxylic acid or anhydride can also include a minor amount of a polycarboxylic acid reactant having at least three carboxylic groups. Thus, up to 20 mole percent of such a polycarboxylic reactant can be used to replace a portion of the dicarboxylic acid component. Representative polycarboxylic acid reactants are well known in the art. They include such acids as trimellitic acid, hemimellitic acid, trimesic acid, 1,2,3,4-benzene tetracarboxylic acid and the corresponding anhydrides thereof where they exist. Where it is desired to include a polycarboxylic acid reactant having a functionality greater than 2 as part of the dicarboxylic acid component of the polyester of the invention, it is necessary to add a compensating amount of a monofunctional alcohol such as ethanol or propanol in order to avoid low molecular weight products and gelation early in the polymerization as predicted by the Carothers equation.

The starches employed in combination with the polyester size additive of the invention can be obtained from potato or corn-derived starches but other sources of starch can also be used. Those starches that are partially degraded are used thus decreasing the viscosity of the starch paste used in the sizing operation as compared to the same solids pastes employing undegraded starch. Starch derivatives can also be used. High solids size compositions can thus be obtained in the aqueous size composition as well as greater penetration of the starch into the cellulosic fibers of the paper or paperboard. As is well known to those skilled in the art, enzyme conversion, oxidation, alkaline-hypochlorite treatment or other oxidizing agents can be used to degrade starch and decrease it's viscosity in aqueous solutions. The preferred starches are those degraded to a fluidity by any of these methods of about 18 to about 97 cc., preferably 75 to 97cc. as determined in the following manner. Five grams of degraded granular starch on a dry basis are placed in a 400 milliliter fluidity beaker containing approximately 100 milliliters of starch paste. To this composition there is then added 9 milliliters of a 0.25 N sodium hydroxide and 10 milliliters of water and the mixture is stirred between 450 and 460 revolutions per minute for 3 minutes. Thereafter the starch paste is poured into a standard fluidity funnel to measure the "water-time" which is defined as the number of seconds for 100 milliliters of water to flow through the funnel. The number of milliliters (or cc) of starch paste which flows through the funnel in the "water-time" is the fluidity of the starch. As a means of comparison, undegraded starch has a fluidity of about 1 cc.

In the preparation of the polyester-starch sizing compositions of the invention, the granular degraded starch or starch derivative is slurried in water containing the polyester of the invention at ambient temperature at a starch solids concentration of 1 to 10 parts by weight, preferably about 3 to about 8 parts by weight, and most preferably about 3 to about 6 parts by weight based upon 100 parts total weight of starch, polyester, and water. The starch is then pasted either by a batch process or by using a continuous starch cooker at a neutral pH of about 6 to 8. The paste is then discharged into the size box. The solids concentration of polyester utilized with said starch is generally about 4 parts to about 60 parts by weight, preferably about 10 parts to about 40 parts by weight, and most preferably about 10 parts to about 30 parts by weight, all based upon 100 parts by weight of starch solids.

Where the size is applied to the paper or paperboard utilizing a size press, the paper web can be moving at a speed of about 50 to about 2,000 feet per minute, the paper being passed between nip rolls of the size press so as to apply the size to one side of the paper. The size can be applied to the other side of the paper by spraying the size composition onto this side or alternatively by passing the paper web through the size bath prior to squeezing excess size from the paper by passing it through the nip of the size press. The polyester-starch size is generally applied to a cellulose-derived paper or paperboard at the rate of 3 to 300 pounds of polyester and 6 to 600 pounds of starch per ton of paper or paperboard. Since the size press utilized to apply the polyester-starch size compositions of the invention is conventional, further description of the process is unnecessary to an understanding of the invention.

If desired, the size compositions of the invention can be applied to cellulosic webs using a trailing blade coater, an air knife, a calendar stack, etc. Water resistance properties of the sized paper can be determined using the Cobb test (TAPPI Standard T-441 OS-69) and dry indicator method commonly known as the sugar-dye test, (TAPPI Standard T-433 M-44), both test procedures hereby incorporated by reference. The following examples illustrate the various aspects of the invention but are not intended to limit it in scope. When not otherwise specified throughout this specification and claims, temperatures are given in degrees centigrade and parts, percentages, and proportions are by weight.

In the following examples, size solutions were prepared using the appropriate amounts of water, starch and polyester, making any necessary pH adjustments with phosphoric acid or caustic soda and "pasting" the starch by heating a starch slurry in combination with the polyester which had been previously dissolved in water using sodium bicarbonate as the base to prepare a 30 percent by weight polyester aqueous solution. The mixture was heated for 10 minutes in a steam-jacketed cooker at a temperature of 90° C. while constantly stirring the mixture. The mixture was then transferred to a storage tank and maintained at 70° C. throughout the paper sizing operation; the required amount of size being delivered from this storage tank to the size press. The paper used was unsized both internally and on the surface and had a basis weight per 1000 square feet of 11.5 to 11.8 pounds. The size press utilized in the following examples was a modified Keegan Coater having two 3.5 inch diameter rolls, the top roll being stainless steel and the bottom roll being rubber. The size was applied to the underside of the paper by means of the bottom roll of the size press which was operated with 40 percent of the roll immersed in the size solution; the size being transferred to the paper from the roll. The size solution was also applied to the top of the paper sheet by spraying the paper with the size solution prior to the paper entering the press section of the size press. The nip pressure of the rolls was maintained at 32 pounds per linear inch during the sizing operation. The sized paper was dried using infrared heaters subsequent to passing through the size press and before being wound on a storage reel. The sized paper was oven-cured at a temperature of 110° C. for a period of 30 minutes.

EXAMPLE 1—(control)

A starch size solution was prepared following the above procedure using a degraded starch sold under the trademark "STAYCO M". Starch was slurried into cold water to a concentration of 25 grams per liter and cooked in accordance with the procedure described above. The size solution was adjusted to a pH of 5.5 and pick up at the size press was found to be 117.3 pounds per ton. Paper sized with this sizing composition in accordance with the above procedure was found to exhibit a Cobb test water pick up of 99.8 grams per a square meter and a wet out time in accordance with the sugar dye test of 2 seconds.

EXAMPLE 2

A size solution was prepared following the procedure used in Example 1 utilizing 25 gams per liter of "STAYCO M," and 1 gram solids per liter of a polyester added as a 30 percent by weight aqueous solution, said polyester having an average molecular weight of 10,000, an acid number of 5.6 and being the reaction product of isophthalic acid, diethylene glycol and phosphoric acid in the respective molar ratio of 0.85, 1.0, 0.15. The pH of the size solution was adjusted to 5.5. Paper sized with this size solution in accordance with the procedure used in Example 1 was determined to have a polyester size pick up of 22.1 pounds per ton by multiplying the total pick up of 110.5 pounds per ton by the ratio of the concentration of the polyester size over the concentration of the starch in the sizing solution. The sized paper exhibited a Cobb test of 42.6 grams per square meter and a sugar dye wet out time of 30 seconds.

EXAMPLE 3

Utilizing the 30 percent by weight polyester aqueous solution of Example 2, a size composition was prepared as in Example 2 but having 10 grams per liter solids concentration of said polyester. The pH of the solution was adjusted to 5 and a polyester size pick up was found to be 66.3 pounds per ton. The sized paper exhibited a Cobb test of 29.9 grams per square meter and a surgar dye test of 26 seconds.

While this invention has been described with reference to certain specific embodiments, it will be recognized by those skilled in the art that many variations are possible without departing from the scope and spirit of the invention and it will be understood that it is intended to cover all changes and modifications of the invention disclosed herein for the purposes of illustration which do not constitute departures from the spirit and scope of the invention.

The embodiments of the invention in which an exclusive property or priviledge is claimed are defined as follows:

1. A process for manufacturing surface-sized paper or paperboard having improved water resistance comprising sizing said paper at the size press with a composition comprising a degraded starch or starch derivative and a polyester wherein said polyester is the reaction product of a dicarboxylic reactant, a diol or polyoxyalkylene glycol, and a phosphorus acid reactant, said polyester having a branched chain, an average molecular weight of about 4,000 to about 11,000, and wherein said starch is selected from the group consisting of alkaline hypochlorite oxidized starches, hydroxyethyl starch ethers, cyanoethyl starch ethers and cationic starches.

2. The process of claim 1 wherein said phosphorus acid reactant is selected from the group consisting of phosphorus pentoxide, orthophosphoric acid, polyphosphoric acid, and mixtures thereof.

3. The process of claim 2 wherein said composition utilized to size said paper is an aqueous size composition wherein said polyester is present in said aqueous size composition containing said polyester in the ration of 4 to 60 parts by weight for each 100 parts by weight of starch solids and said starch is present in said aqueous size composition in a total amount of about 1 part to about 10 parts by weight based on 100 parts total weight of said water, starch, and polyester.

4. The process of claim 3 wherein said polyester is the reaction product of isophthalic acid, diethylene glycol and a phosphorus acid reactant.

5. The process of claim 4 wherein said phosphorus acid reactant is orthophosphoric acid.

* * * * *